US010638814B2

(12) United States Patent
Mancini et al.

(10) Patent No.: US 10,638,814 B2
(45) Date of Patent: May 5, 2020

(54) SHOE ENGAGEMENT AND BUMPER INSERT SYSTEM AND METHOD FOR USING THE SAME

(71) Applicant: JM Promotions, Inc., New Rochelle, NY (US)

(72) Inventors: Jeff Mancini, New Rochelle, NY (US); Elizabeth M. Andrews, Chicago, IL (US)

(73) Assignee: WORLDOLUXE LLC, Chicago, IL (US)

( * ) Notice: Subject to any disclaimer, the term of this patent is extended or adjusted under 35 U.S.C. 154(b) by 359 days.

(21) Appl. No.: 15/091,747

(22) Filed: Apr. 6, 2016

(65) Prior Publication Data

US 2016/0295969 A1 Oct. 13, 2016

Related U.S. Application Data

(60) Provisional application No. 62/269,283, filed on Dec. 18, 2015, provisional application No. 62/146,491, filed on Apr. 13, 2015.

(51) Int. Cl.
*A43B 23/28* (2006.01)
*A43B 7/14* (2006.01)

(52) U.S. Cl.
CPC ..... *A43B 23/28* (2013.01); *A43B 7/145* (2013.01); *A43B 7/149* (2013.01)

(58) Field of Classification Search
CPC ..... A43B 23/28; A43B 7/145; A43B 7/129
USPC ..... 36/58.6
See application file for complete search history.

(56) References Cited

U.S. PATENT DOCUMENTS

| | | | | |
|---|---|---|---|---|
| 715,543 | A | 12/1902 | Bosworth | |
| 1,018,652 | A * | 2/1912 | Drechsler | A43B 23/28 36/58.5 |
| 1,028,586 | A * | 6/1912 | McMullan | A43B 23/28 36/58.5 |
| 1,174,619 | A * | 3/1916 | Scholl | A43B 23/28 36/58.5 |
| 1,299,983 | A | 4/1919 | Martyn et al. | |
| 1,299,989 | A | 4/1919 | Martyn et al. | |
| 1,966,179 | A | 7/1934 | Lesch | |
| 2,163,012 | A * | 6/1939 | Schenk | A61F 13/063 128/894 |
| 2,438,280 | A | 3/1948 | Gailey | |

(Continued)

FOREIGN PATENT DOCUMENTS

| | | |
|---|---|---|
| CN | ZL 200920007148.2 | 12/2009 |
| CN | ZL 201020602730.6 | 8/2011 |

(Continued)

*Primary Examiner* — Anne M Kozak
(74) *Attorney, Agent, or Firm* — Andrew F. Young, Esq.; Lackenbach Siegel, LLP

(57) ABSTRACT

A bumper system for use in a shoe may include one or more elastomeric members having a curved top portion opposite a generally flat bottom portion; an adhesive layer on said bottom portion; and a peel-removable cover of said adhesive layer, wherein the one or more elastomeric members includes a first elastomeric member that is configured to be secured within a toe box of the shoe and is configured to match a foot-toe-gap arc of a user of the shoe. A method of using a bumper system in a shoe is also disclosed.

12 Claims, 8 Drawing Sheets

(56) References Cited

U.S. PATENT DOCUMENTS 2,489,429 A * 11/1949 Nathan ..... A43B 23/28 248/363
2,506,308 A 5/1950 Maynier
2,969,062 A * 1/1961 Landau ..... A61F 13/063 128/894
D192,784 S 5/1962 Bradley et al.
3,110,306 A 11/1963 Posner
4,179,826 A 12/1979 Davidson
4,266,350 A 5/1981 Laux
D318,563 S 7/1991 Lucas
5,172,494 A 12/1992 Davidson
D391,390 S 3/1998 Pallister
5,799,416 A * 9/1998 Prober ..... A43B 23/28 36/58
5,799,417 A 9/1998 Burke et al.
5,842,292 A * 12/1998 Siesel ..... A43B 23/28 36/58.5
6,018,891 A 2/2000 Duclos
6,101,655 A * 8/2000 Buddle ..... A43B 23/28 12/146 C
6,510,626 B1 1/2003 Grenawalt
6,662,474 B2 12/2003 Tomat
D489,458 S * 5/2004 Joseph ..... D24/192
6,810,603 B1 11/2004 Cosentino
7,168,188 B2 1/2007 Auger et al.
7,329,448 B2 * 2/2008 Cunningham ..... A43B 1/0027 128/889
7,735,243 B1 6/2010 Giley et al.
D628,782 S 12/2010 Butler
D629,189 S 12/2010 Feldman
8,191,285 B2 6/2012 Perron
D676,641 S 2/2013 Lin
8,695,235 B2 4/2014 Perron
2006/0026866 A1 2/2006 Avent et al.
2009/0193683 A1 * 8/2009 Igdari ..... A43B 7/142 36/91
2009/0255147 A1 10/2009 Castillo
2010/0146816 A1 6/2010 Cappaert et al.
2014/0068967 A1 * 3/2014 Jones ..... A43B 7/145 36/43
2014/0213954 A1 7/2014 Roth et al.
2014/0259771 A1 * 9/2014 Dananberg ..... A43B 3/14 36/92
2016/0183635 A1 * 6/2016 Mancini ..... A43B 23/28 36/58.6
2017/0027285 A1 * 2/2017 Mancini ..... A43B 23/28

FOREIGN PATENT DOCUMENTS

CN ZL 201120520545.7 7/2012
CN ZL 201220755764.8 12/2012
CN 201310332961.8 8/2013
CN 201320468786.0 8/2013
CN ZL 201420032265.5 1/2014
CN ZL 201420713222.3 11/2014
CN ZL 201420713224.2 11/2014
CN ZL 201520059860.2 1/2015
CN ZL 201430096755.7 3/2015
CN ZL 201480001521.7 5/2015
CN ZL 201520542062.5 7/2015
CN 204796861 U 11/2015
WO WO 2007/049024 10/2006

* cited by examiner

SHOE ENGAGEMENT AND BUMPER INSERT SYSTEM AND METHOD FOR USING THE SAME

CROSS REFERENCE TO RELATED APPLICATIONS

This application claims priority to and the benefit of U.S. Prov. Pat. App. No. 62/146,491 filed on Apr. 13, 2015 and U.S. Prov. Pat. App. No. 62/269,283 filed Dec. 18, 2015, the entire contents of which are incorporated herein by reference.

FIGURE SELECTED FOR PUBLICATION

FIG. 12

BACKGROUND OF THE INVENTION

Field of the Invention

The present invention generally relates to a shoe engagement and bumper insert system for improved security and comfort. More particularly, the present invention provides a shoe engagement and bumper insert system and method for using the same which reduces the tendency of a wearer's foot to slide forward in a shoe during use and cause increased pressure or discomfort.

Description of the Related Art

Regardless of the outer cosmetic features or styling of the shoe(s), the interior area of any shoe is substantially a reflection of the need to fit a user's foot. Unfortunately, both the interior of any shoe varies by the type of shoe (flat or raised) and there is variation between a wearer's foot-shape as well. All shoes built on the same shoe last will thus have the same interior region and dimensions, and will generally yield the same fit for a particular wearer, but will yield different fits for different wearers. Consequently, there is a need for a user to adjust and modify the fit of a shoe to his or her foot to secure a comfort and secure fit and provide adequate support such that the shoes perform essentially as an extension of the human foot, as is typically desired.

Some shoe manufacturing steps include a precise and sometimes tedious process (e.g., custom shoes) while other manufacturing steps are relatively loose and generic (e.g., flip-flop sandals). In particular, while a custom cast of a foot might be utilized for measurement purposes to make a custom pair of shoes, an elevated heel (for high heeled shoes) and any sharp angling between the upper surface of the base and the sole surface can create a sharply-angled bottom line. Because of the differences between a human foot and a conventional shoe mold or last, shoes made with a conventional shoe lasts fail to work in harmony with the human foot. For example, conventional lasts may have sharply defined lines at the point of transition from the flat sole surface or crown to the vertical sidewalls of the shoe last between the defined line and the last ridge; human feet are not as sharply angled.

In other words, the shoe last ridge and sharply-angled contours of a conventional last only take into account generally the static shape of the foot, i.e., the shape of the foot when it is in one position. However, when a shoe is worn, the foot will further undergo dynamic shape changes when a person is walking or running. Conventional shoe lasts utilize heel curves that are overly exaggerated such that shoes formed with the shoe lasts promote a gripping of the foot by the shoe. The heel seat of a conventional last is angled to correspond to the introduction of an elevated heel onto the sole surface. However, the heel of a human foot is not elevated and has no such heel pitch. In the toe region of a conventional shoe last, the toe profile decreases or recedes to the sharply defined line in the forepart of the last. In contrast to the shape of the toe region of a conventional shoe last, human toes generally maintain a uniform thickness throughout their length.

Also, for elevated conventional shoes these are typically engineered to distribute the pressure on the foot across 100% of the bottom surface, i.e., across 100% of the rigid and flat sole surface. However, the average human foot is engineered to distribute such pressures across on about 75-80% of the bottom surface of the foot. Therefore, conventional shoe technology dictates that the footwear manufactured thereon will unnaturally affect the weight bearing and propulsion characteristics of the foot. As a result of the shape and dimensions of conventional lasts, the shoe lasts and the shoes manufactured thereon have fallen short of the goal of providing footwear that work in harmony with the human foot and that provide adequate comfort to the wearer.

A further major drawback with conventional shoe lasts is that the flat bottom sole surface dictates that a flat, rigid piece of sole material be attached to footwear upper material at the sharply-angled shoe last line, thus producing footwear that has an excessive angled feather edge. The foot is thereby supported artificially on a stiff, flat platform even though the human foot at rest, and particularly in motion, tends to move toward or falls off the end of the stiff sole platform of the shoe. This increases the risk of ankle injuries. The drawbacks of the sharply-angled feather edge of a shoe made from conventional lasts are exacerbated by the elevation of the heel seat, the recession of the toe, and the unnatural forward pitch of the heel seat, thus resulting in undue pressure on the ball of the wearer's foot.

FIG. 1 depicts an example of a raised-heel shoe 20 having a cup shaped heel 21 manufactured from a conventional shoe last, which has a heel height $\propto$, which may be for example approximately 2 inches (or approximately 5 cm). As shown, the shoe is on a ground plane 18 from which the heel height $\propto$to the heel seat 19 is measured. The heel seat 19 is shown to be inclined upwardly at an angle "X", which may be approximately 12-15 degrees, relative to the ground plane 18. The shank-reinforced midsole region 15 is angled downwardly and forwardly of the shoe from the heel seat at an angle "Y", which may be approximately 30 degrees, relative to the ground plane. In a toe region or box 22 of the shoe, the great toe may be essentially parallel to the ground plane. However, the toe region or box 22 may be inclined upwardly and forwardly by the upward and forward inclination of the toe region at an angle "Z", which may be between 2 and 3 degrees inclusive, relatively to the ground plane 18. As will be appreciated, a conventional high-heeled shoe such as that shown in FIG. 1 places the wearer's foot 10 essentially on an inclined plane. This urges the foot 10 forward by gravity toward the toe box 22 when the wearer is standing or walking and also loosens the cup shaped heel 21. Indeed, when walking quickly, or descending stairs, the stress into the toe box may be extreme. This results in undue pressure on the ball 16 or forefoot 12 regions of the foot 10, which may result in jamming of the toes 13. Such undue pressure on the ball or forefoot regions of the foot may result in a burning sensation in these areas of the foot, and may also result in fatigue and/or discomfort.

In a related manner FIG. 2 represents a conventional flat shoes (having a heal) or flip flop type shoe (shown here as 40) where there is only a connection of a foot bed 30 linking with a Y-shaped strap system 31, having a split-toe divider 32 secured to the foot bed 30 by a series of received stop members 33. During walking foot 10 flexes and it is necessary to grip with the toes 13 the divider 32 to keep foot 10 aligned with foot bed 30. As an additional concern with flat shoes either with a heel 21 or in a flip flop form (no heal) or sandal form there are many occurrences of a foot 10 becoming displaced relative to the shoe body.

In FIG. 3 a further conventional foot wear item 45 in the form of a platform sandal has a raised heel 86 and a toe portion 90 to secure a foot 10 but during a use there is movement of strap members 46 relative to the foot 10 along motion pathways 80 (front-back) and along pathways 78 (up-down). Each of these motions creates displacement of the foot relative to the shoe and lack of security and discomfort.

As an additional concern, where a shoe of any conventional type 20, 40, 45, or otherwise, an initial fit may not be perfect (e.g., too loose) and so additional sliding may occur.

Accordingly, there is a need for an improved bumper and foot securing system and method for using the same.

ASPECTS AND SUMMARY OF THE INVENTION

In response, it is now recognized the proposed invention addresses at least these needs.

A bumper system for use in a shoe may include one or more elastomeric members having a curved top portion opposite a generally flat bottom portion; an adhesive layer on said bottom portion; and a peel-removable cover of said adhesive layer. The one or more elastomeric members may include a first elastomeric member that is configured to be secured within a toe box of the shoe and is configured to match a foot-toe-gap arc of a user of the shoe. The one or more elastomeric members may also include a second elastomeric member that is configured to be secured with a rear cup shaped heel of the shoe and a third elastomeric member that is configured to be secured to a rear end of a foot bed of the shoe.

The elastomeric members may include features that facilitate curving or bending or cutting of the elastomeric members. At least one protuberance may be included on the curved top portion of the elastomeric member and/or at least one reduced thickness region along a length of the elastomeric member. One or more recessions may facilitate curving or bending of the elastomeric member. The recessions may be arranged on opposing sides of the elastomeric member. Gaps may be arranged on at least one side of the length of the elastomeric member to facilitate bending of the elastomeric member. One or more grooves may facilitate cutting of the elastomeric member to a predetermined length.

At least one elastomeric member may include a receiving geometry configured to receive a portion of the shoe therein. The receiving geometry may include fingers that are configured to wrap around a thong of a sandal. The fingers may be arranged symmetrically with respect to one another and/or at least one of the fingers may extend over a space defined for receiving the thong.

A method for using a bumper system in a shoe may include the steps of: providing an elongate elastomeric member having a curved top portion opposite a generally flat bottom portion and including a receiving geometry; an adhesive layer on said bottom portion; and a peel-removable cover of said adhesive layer; conducting a positioning step for said bumper system in said shoe, including at least one of a bending, a cutting to length, and an arc-forming; removing said cover from said adhesive layer; and press-securing said bumper system in said shoe. The elongate elastomeric member may include a receiving geometry, and the method may further comprising positioning the elongate elastomeric member relative to the shoe such that a portion of the shoe is received within the receiving geometry. The at least one elongate elastomeric member may include a first elastomeric member that is configured to be secured within a toe box of the shoe and is configured to match a foot-toe-gap arc of a user of the shoe, and may be secured the first elastomeric member within the toe box. The at least one elongate elastomeric member may further includes a second elastomeric member that is configured to be secured with a rear cup shaped heel of the shoe, and may be secured to the rear cup shaped heel of the shoe. The at least one elongate elastomeric member may further include a third elastomeric member that is configured to be secured to a rear end of a foot bed of the shoe, and may be secured to the rear end of the foot bed of the shoe.

The above and other aspects, features and advantages of the present invention will become apparent from the following description read in conjunction with the accompanying drawings, in which like reference numerals designate the same elements.

BRIEF DESCRIPTION OF THE DRAWINGS

FIG. 6 is a section along section line 6-6 in FIG. 5 and FIG. 7 is a section along line 7-7 in FIG. 5;

DETAILED DESCRIPTION OF THE PREFERRED EMBODIMENTS

Figure 1:
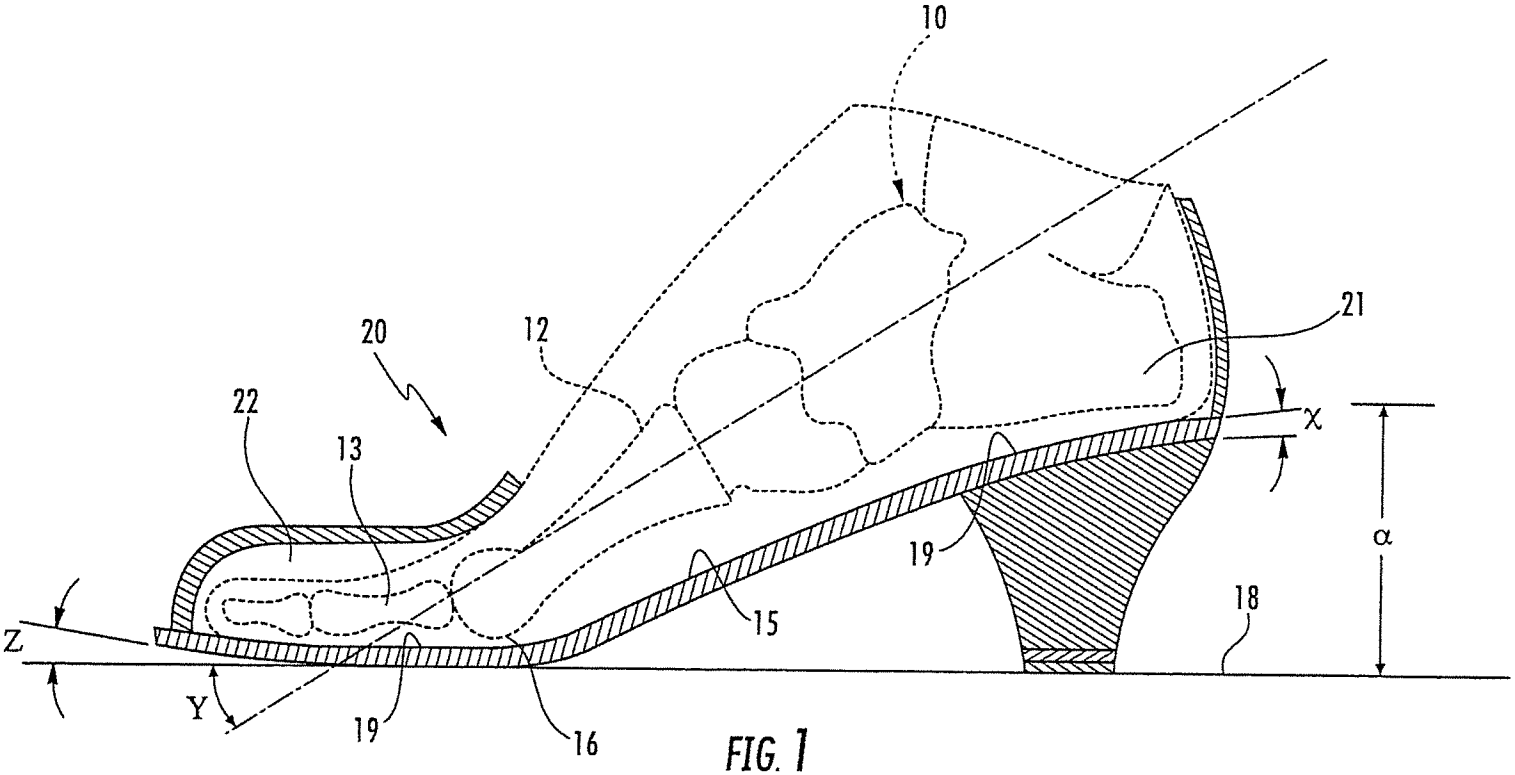
FIG. 1 PRIOR ART
FIG. 1 is a partial sectional illustration view of a conventional raised shoe and foot assembly noting the conventional arrangement.
Figure 2:
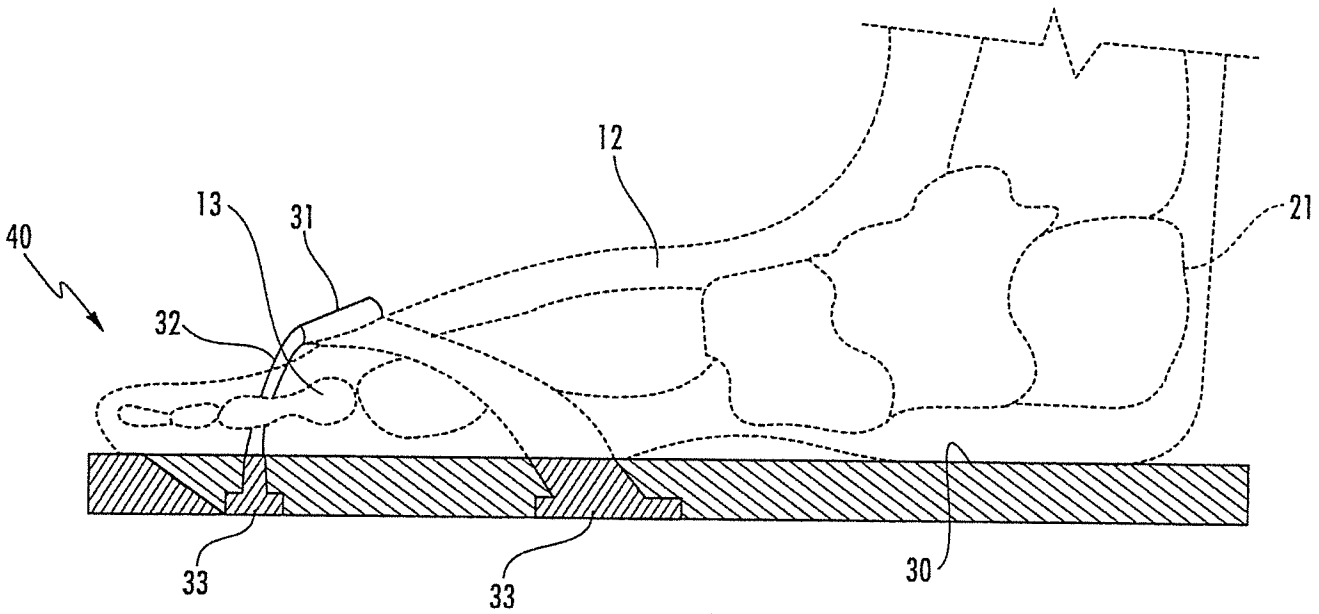
FIG. 2 PRIOR ART
FIG. 2 is partial sectional illustration view of a conventional flat shoe and foot assembly noting the conventional foot arrangement.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

One of the present inventions is noted in FIGS. 4 through 7 as a bumper system 70 having an elongated shape and a curved upper portion 71 and a flat bottom portion 72. On flat bottom portion 72 is an adhesive layer and a removable cover film (both not shown). The adhesive layer and removable cover film may be of any conventional adhesive and film suitable for adhering to a shoe and being stored for transport for peal-and-stick application.

The curved upper portion 71 optionally has a series of ridges 73 between depressions 74 to aid in gripping a foot as will be discussed. To assist in curving the elongate bumper system 70 one or more recessions 75, 75 are provided along the curvature of system 70 to a preferred arc—as will be discussed. One example of a preferred arc is shown at 76, 76 in FIG. 4, however this is not limiting, and an arc may be either symmetrical or asymmetric relative to user's need and desire as will be discussed.

Figure 5:
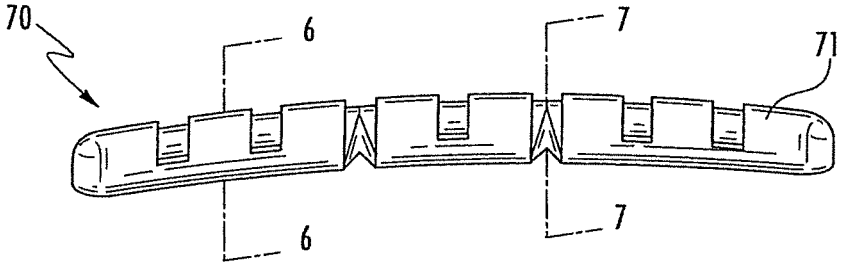
Figure 6:
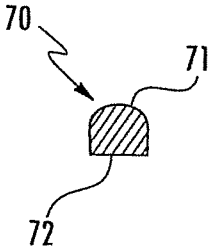
Figure 7:
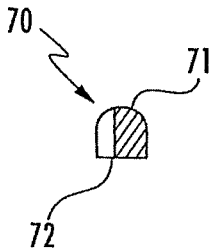

As will be noted in FIG. 7 along section line 7-7 in FIG. 5, the cross-section portion noted in recession region 75 is smaller than the overall section line 6-6 in FIG. 6, and as a result, system 70 may be readily bent and curved as needed.

Figure 8:
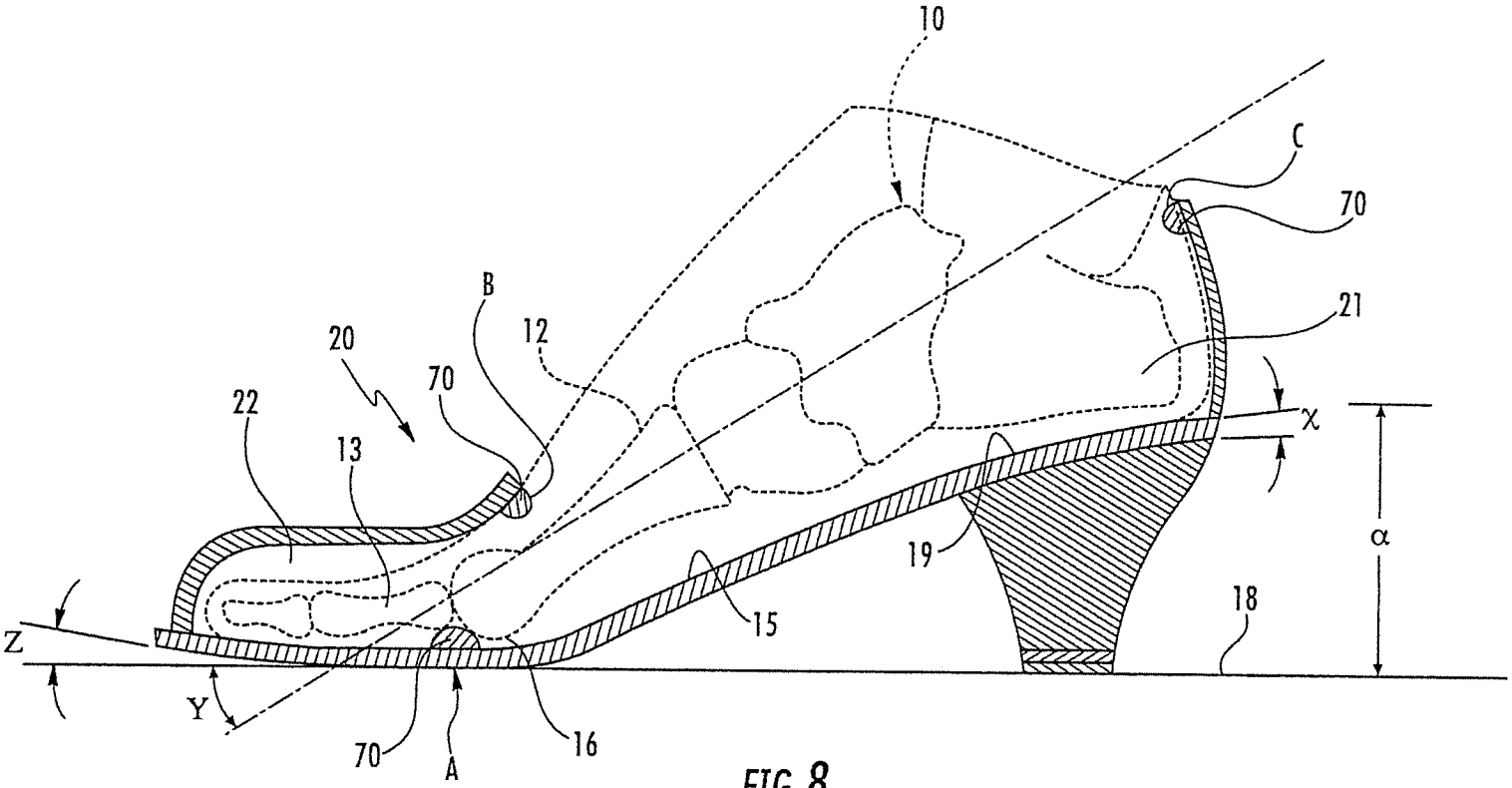
FIG. 8 is a modified illustrated view of FIG. 1 with the bumper device 70 installed between a toe and the ball of a user's foot to prevent sliding on a foot bed.

Referring now to FIG. 8, for the use of a bumper system 70 positioned within a closed-toe shoe 20 between the toe 13 and ball 16 of a foot 12, and secured to the foot bed region as shown by adhesive upon removal of a backing member (not shown). In this position, bumper system 70 is slightly arcuate (as in FIG. 4) to match the foot-toe-gap arc of a user and to fill in this gap. As such, bumper system 70 provides a slid-resistance for user's moving their foot relative to the position in shoe 20 and prevents unintended sliding-forward or sliding-rearward. As shown the foot-toe-gap will be designated as position A. However, it will be understood that bumper system 70 may be positioned at the rear cup shaped heel 21 in a position C as shown, or optionally under an upper toe-box cover position B as shown. Alternatively, multiple bumper systems 70 may be used depending upon a user's desire.

Figure 9:
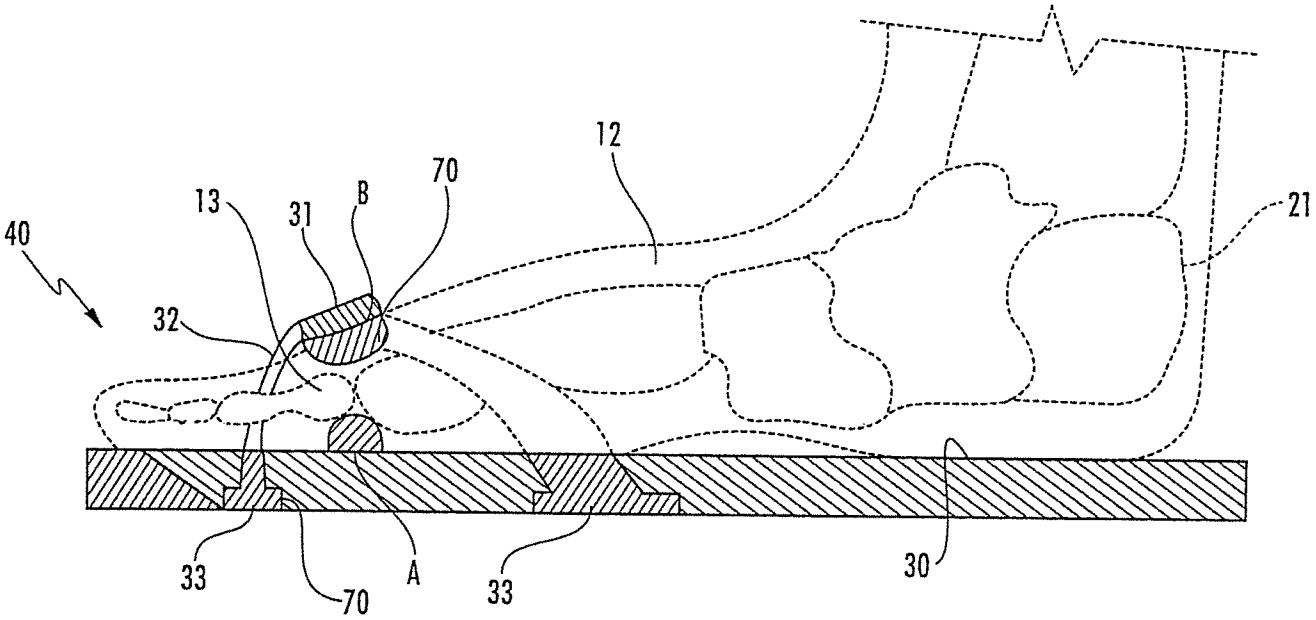
FIG. 9 is a modified illustrated view of FIG. 2 with a bumper device 70 installed between a toe and the ball of a user's foot to prevent sliding and secure the foot to the strap as shown.

As will be seen also from FIG. 9, a foot-toe-gap position A is provided with bumper system 70 following adhesive backing removal and application to foot bed 30. Additionally, the strap position B may be provided with a bumper system 70. Further, a bumper system 70 may be in both position A and B for a strap member combination.

Figure 3:
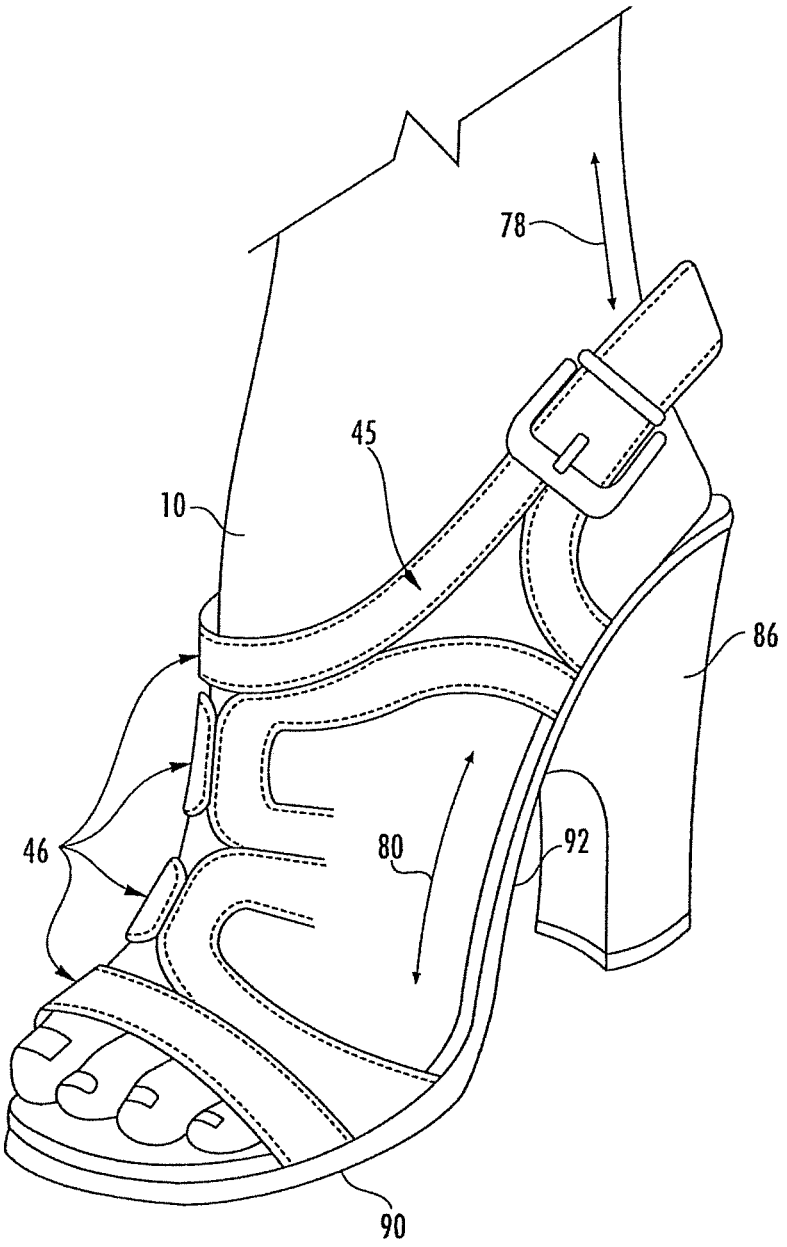
FIG. 3 PRIOR ART
FIG. 3 is a partial illustration view of a raised heel sandal construction noting foot movement.
Figure 4:
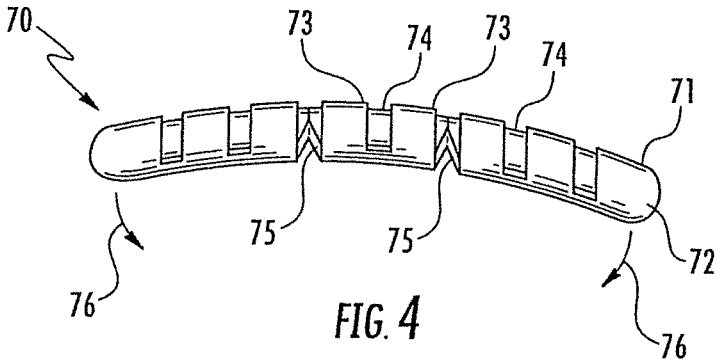
FIGS. 4-7 are a proposed bumper device where

It will be further understood that for a high-heel sandal 45 (as noted in FIG. 3), bumper systems 70 may be in along a top strap (re. position C) to prevent motion 78 or along the foot bed in position A or under a bottom strap 46 in position B to prevent motion 80.

In sum, the use of the adaptive bumper system 70 allows for ready adaptation of a foot wear item and avoidance of the discomfort noted. It will also be understood that any type of footwear device from sandal, boot, flat shoe, high heel, for either men or women, of any kind may be described herein as a 'shoe' without departing from the scope and spirit of the present invention. It will be also understood that bumper system 70 may be of any modulus of elasticity made of an elastomeric material suitable for use, including a material that has a smooth-non-sticky interface (rubber) and a sticky-interface (silicone).

As further will be noted a method of use would include the selection of a bumper 70, optionally cutting to length (with scissors or otherwise), shaping to an arc desired, removing the adhesive backing, and pressing the device into position within a selected shoe, and then test-fitting by a user.

Figure 10A:
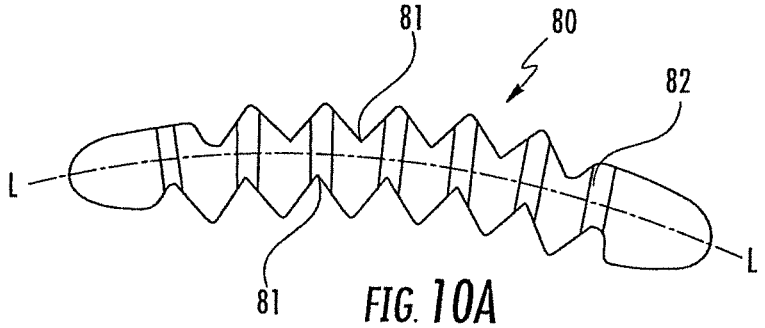
FIG. 10A-10F illustrate differently configured bumper devices.

Other bumpers are described with respect to FIGS. 10A-10F. As shown in FIG. 10A, a flexible bumper 80 may have a generally elongated shape and may include one or more recessions 81 on opposing sides of axis extending along a length thereof. Such recessions 81 may facilitate curving or bending of the bumper 80 to a preferred arc. Moreover, the bumper 80 may include groove 82 to facilitate cutting or trimming the bumper 80 to a desired length.

As shown in FIGS. 10B-10E, bumpers 90A-90D are configured to be secured to a thong (e.g., split-toe divider 32) of a sandal (e.g., sandal 40).

Figure 10B:
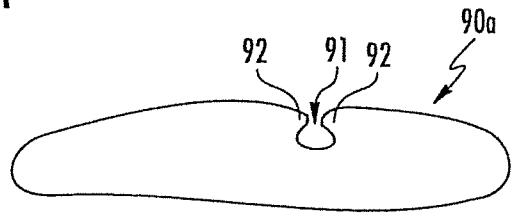

As shown in FIG. 10B, bumper 90A has a generally elongated shape and includes an open section 91 or alternatively a gripping assist section 91 in which a space is defined within the bumper 90A to receive the thong therein for alignment aid. Fingers 92 may wrap around the thong to secure and help position the bumper as closely as possible to the same location as the thong member post (shown in FIG. 11), while maintaining the bumper position, so as to allow maximum comfort and minimize a rolling-force upon foot removal and thereby minimize a removal of the bumper 90A from the thong. As shown in FIG. 10B, the fingers 92 of section 91 may define a space therebetween, and may be generally symmetrically positioned with respect to one another.

Figure 10C:
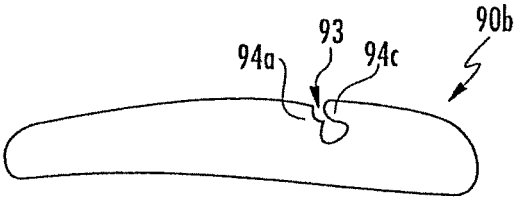
Figure 11:
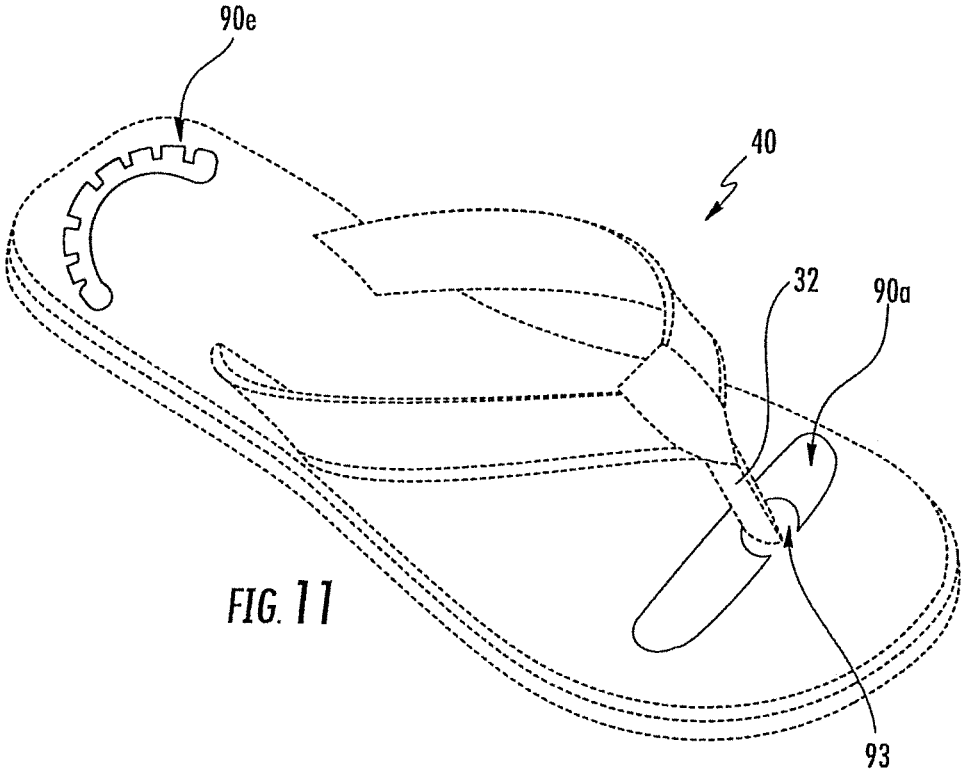
FIG. 11 is a perspective view of an open-toed thong-type flat sandal including bumpers adhered to its footbed to reduce lateral displacement in stepping, to guide the toes for improved comfort and walking-control and to increase safety.

Alternatively, as shown in FIG. 10C, a similar bumper 90B may include an opening section 93 having fingers 94*a*, 94*b* that are arranged asymmetrically such the finger 94*b* extends over the space defined for the reception of the thong such that the finger 94*b* impedes the path for the removal of the bumper 90B from the thong once the two are coupled and which allows the bumper to maintain alignment with the thong member 32 (FIG. 11).

Figure 10D:
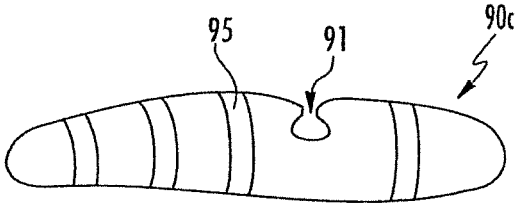

FIG. 10D depicts a bumper that is similar to the bumper 90A, but also includes grooves 95 which may facilitate bending and/or cutting or trimming of the bumper 90C (trimming along a cut line will provide a smoother profile).

Figure 10E:
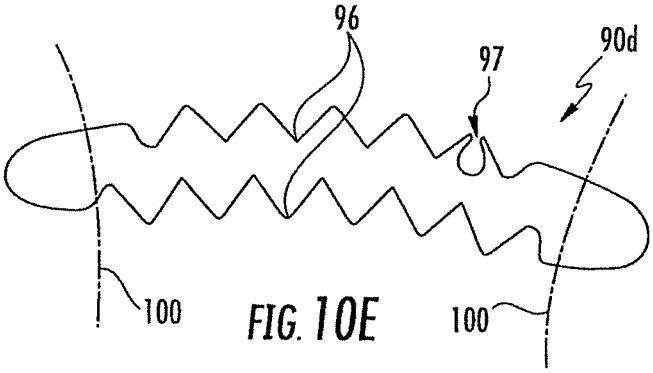

Another bumper 90D shown in FIG. 10E is substantially similar to bumper 80 in that it includes recessions 96 that are substantially similar to the recessions 81, but may also include a section 97 similar to that of the sections 91, 93 such that the bumper 90D may be secured to a thong of a sandal and positioned in close alignment.

As additionally illustrated in FIG. 10E, designation of cut-lines 100, 100 may be provided as marked indicia on a bumper, or as stress-reducing segments or tear-opening sections, to aid a user to reduce an overall bumper to a desired length.

Figure 10F:
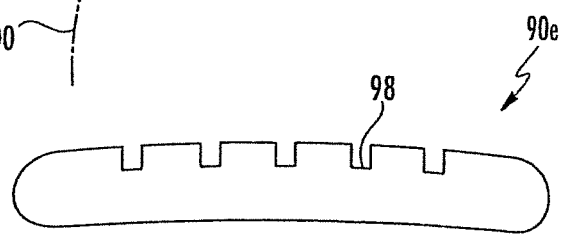

Another bumper 90E, as shown in FIG. 10F, may be generally elongated and include gaps 98 on at least one side along its length to facilitate bending or curving of the bumper 90E. Each of the bumpers 80-90E may include an adhesive backing to facilitate securing or affixing of the bumpers to a footbed of a shoe or sandal or the like.

Figure 12:
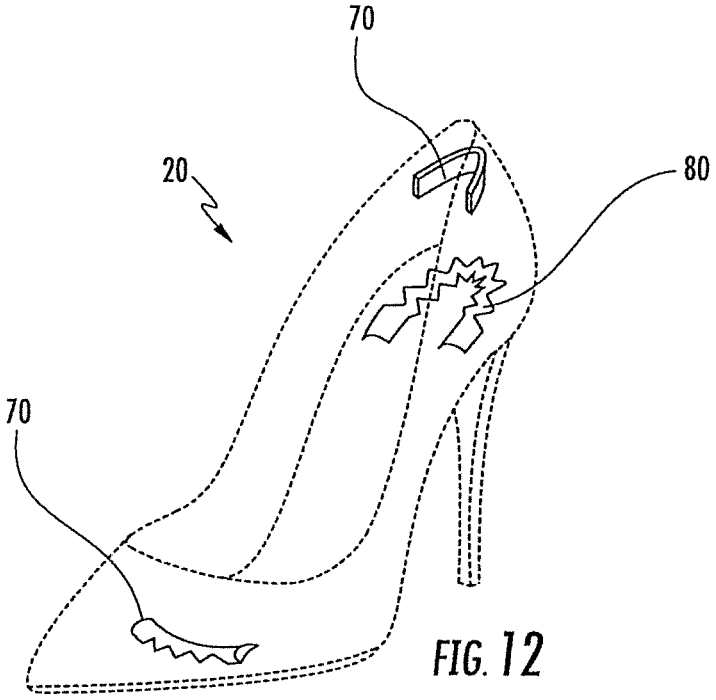
FIG. 12 is a perspective view of a closed-toe heel shoe including bumpers adhered to its footbed to reduce lateral displacement in stepping, to guide the toes for improved comfort and walking-control and to increase safety.

Sandal 40 may have one or more bumpers secured to its footbed. As shown in FIG. 11, for example, bumper 90A may be secured to a front section of the sandal 40 such that it is positioned under a user's toes when the sandal is worn to inhibit relative movement of the user's foot along the length of the sandal. In particular, split-toe divider 32 may be coupled to bumper 90A (or alternatively bumper 90B, 90C, or 90D, for example) which receives the divider within the gripping opening section 93. Another one of the bumpers, for example, bumper 90E may be positioned at the rear of the sandal and curved such that it is configured to snugly be positioned against the heal of the user's foot, thereby preventing the foot from slipping or translating relative to the footbed of the sandal 40. As noted in FIG. 12, a bumper 70 is also positioned under a user's toes or along an arc-of the user's heel at the rear-shoe lip (as in FIG. 8), but also shown positioned in a U-or-V-shaped position proximate a user's heel 9 as in FIG. 11 to enhance a lateral-stability and positioning of a user's heel in a shoe.

While not specifically illustrated herein, Applicant recognizes the discussed elongate bumper members may additionally be integrally formed with either a removable full-insole for a shoe (co-molded in the removable insole in the positions noted) or may be integrally formed with the footbed of a shoe (formed during initial manufacturing into the footbed of the shoe or side wall of a heel-wall). These improvements and updates will be understood by those of skill in the art of footwear design to be discussed and understood from the above-description and within the scope of the present invention.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. A bumper system for use in a shoe, comprising:

at least one elastomeric member having a curved top portion opposite a flat bottom portion defining a total thickness between said curved top portion and said flat bottom portion;

an adhesive layer on said flat bottom portion;

a peel-removable cover on said adhesive layer;

at least one protuberance on said curved top portion;

at least one reduced thickness region along a length of said at least one elastomeric member;

said at least one reduced thickness region further comprising: one or more recessions that facilitate a curving of the at least one elastomeric member;

the one or more recessions are arranged located on each opposing side along a length of said at least one elastomeric member from a proximal end to a distal end;

wherein the at least one elastomeric member includes a first elastomeric member that is configured to be secured to a portion of said shoe; and wherein the at least one elastomeric member includes one or more grooves that facilitate separating the at least one elastomeric member to a predetermined length.

2. The bumper system of claim 1, further comprising:

at least a second said elastomeric member configured to be secured to a curved upper portion of the shoe that is configured to cover a heel of a wearer.

3. The bumper system of claim 1, further comprising:

at least a second said elastomeric member configured to be secured to a rear end of a foot bed of the shoe.

4. The bumper system of claim 1, wherein:

the at least one elastomeric member further includes a second elastomeric member that is configured to be secured to a curved upper portion of the shoe that is configured to cover the heel of a wearer and a third elastomeric member that is configured to be secured to a rear end of a foot bed of the shoe.

5. The bumper system of claim 1, wherein at least one elastomeric member includes an opening that is configured to receive a portion of the shoe.

6. The bumper system of claim 5, wherein the shoe is a sandal, and wherein the at least one elastomeric member further includes finger elements forming a portion of a boundary of the opening that is configured to receive a portion of the shoe.

7. The bumper system of claim 6, wherein the finger elements are arranged symmetrically with respect to one another.

8. The bumper system of claim 6, wherein one finger element of the finger elements extends proximate a space defined for receiving a thong of said sandal.

9. A bumper system for use in a shoe, comprising:

one or more elastomeric members having a top portion opposite a flat bottom portion;

an adhesive layer on said bottom portion;

a peel-removable cover of said adhesive layer;

at least one protuberance on said curved top portion;

at least one reduced region along a length of said elastomeric member;

said at least one reduced thickness region further comprising: one or more recessions that facilitate a curving of the one or more elastomeric members;

the one or more recessions are arranged located on each opposing side along a length of the one or more elastomeric members from a proximal end to a distal end; and wherein the one or more elastomeric members includes a first elastomeric member that is configured to be secured within to a portion of said shoe; and wherein said one or more elastomeric members includes one or more grooves that facilitate separating the at least one elastomeric member to a predetermined length.

10. A bumper system, according to claim 9, further comprising:

said first elastomeric member being configured to be positioned in at least one shoe location, said shoe location selected from a group of shoe locations consisting of an area configured to bear the toes of a wearer of the shoe, a curved upper portion of the shoe configured to cover the heel of said wearer, a rear end of a foot bed of the shoe, and a strap member of said shoe, whereby said one or more elastomeric members is configured to aid in positioning of a user's foot upon said shoe during use.

11. The bumper system, according to claim 10, further comprising:

the one or more elastomeric members including a second elastomeric member; and each of the first elastomeric member and the second elastomeric member being capable of being secured within one of said group of shoe locations.

12. The bumper system of claim 11, further comprising:

at least one opening along a length of each of the first elastomeric member and the second elastomeric member; and said at least one opening is configured to receive a portion of the shoe the strap member.

* * * * *